US011466678B2

(12) United States Patent
Stair et al.

(10) Patent No.: US 11,466,678 B2
(45) Date of Patent: Oct. 11, 2022

(54) FREE PISTON LINEAR MOTOR COMPRESSOR AND ASSOCIATED SYSTEMS OF OPERATION

(71) Applicants: Jason Stair, Chicago, IL (US); Anthony Lindsay, Geneva, IL (US); Michael Lewis, Austin, TX (US); Raymond Zowarka, Austin, TX (US); Siddharth Pratap, Austin, TX (US); Clay Hearn, Austin, TX (US); Charles Penney, Round Rock, TX (US); Michael Worthington, Spicewood, TX (US); Hsing-Pang Liu, Austin, TX (US)

(72) Inventors: Jason Stair, Chicago, IL (US); Anthony Lindsay, Geneva, IL (US); Michael Lewis, Austin, TX (US); Raymond Zowarka, Austin, TX (US); Siddharth Pratap, Austin, TX (US); Clay Hearn, Austin, TX (US); Charles Penney, Round Rock, TX (US); Michael Worthington, Spicewood, TX (US); Hsing-Pang Liu, Austin, TX (US)

(73) Assignees: GAS TECHNOLOGY INSTITUTE, Des Plaines, IL (US); BOARD OF REGENTS, THE UNIVERSITY OF, Texas System Austin, TX (US)

( * ) Notice: Subject to any disclaimer, the term of this patent is extended or adjusted under 35 U.S.C. 154(b) by 653 days.

(21) Appl. No.: 15/785,963

(22) Filed: Oct. 17, 2017

(65) Prior Publication Data

US 2018/0051690 A1 Feb. 22, 2018

Related U.S. Application Data

(63) Continuation-in-part of application No. 14/536,174, filed on Nov. 7, 2014, now Pat. No. 10,323,628.
(Continued)

(51) Int. Cl.
*F04B 49/06* (2006.01)
*F04B 35/04* (2006.01)
(Continued)

(52) U.S. Cl.
CPC ..... *F04B 49/065* (2013.01); *F04B 17/042* (2013.01); *F04B 19/003* (2013.01);
(Continued)

(58) Field of Classification Search
CPC ..... F04B 35/045; F04B 25/02; F04B 39/005; F04B 17/04; F04B 17/046; F25B 1/10;
(Continued)

(56) References Cited

U.S. PATENT DOCUMENTS 3,937,600 A 2/1976 White
4,345,442 A 8/1982 Dorman
(Continued)

FOREIGN PATENT DOCUMENTS

DE 834 125 C 3/1952
EP 0 106 414 A2 4/1984
(Continued)

OTHER PUBLICATIONS

U.S. Patent Office, English language version of the International Search Report, Form PCT/ISA/210 for International Application PCT/US2018/56103, dated Dec. 21, 2018 (3 pages).
(Continued)

*Primary Examiner* — Nathan C Zollinger
(74) *Attorney, Agent, or Firm* — Pauley Erickson & Swanson

(57) ABSTRACT

A linear motor compressor including a compressor housing and a cylinder housing having a plurality of opposing compression chambers. A piston freely reciprocates within the cylinder housing using a linear electric motor. A piston position feedback control system provides adaptive current output as a function of position feedback and/or velocity feedback from the piston and/or the electric motor, to directly power and control the electric motor, wherein the piston reciprocates without assistance from a mechanical spring or other equivalent centering force.

12 Claims, 10 Drawing Sheets

Related U.S. Application Data

(60) Provisional application No. 61/901,176, filed on Nov. 7, 2013.

(51) Int. Cl.

| | |
|---|---|
| ***F04B 31/00*** | (2006.01) |
| ***F04B 25/02*** | (2006.01) |
| ***F04B 17/04*** | (2006.01) |
| ***F04B 19/00*** | (2006.01) |

(52) U.S. Cl.
CPC ..... *F04B 25/02* (2013.01); *F04B 31/00* (2013.01); *F04B 35/045* (2013.01); *F04B 2201/0201* (2013.01); *F04B 2201/0202* (2013.01); *F04B 2203/0401* (2013.01)

(58) Field of Classification Search
CPC ..... H02K 33/00; H02K 33/12; H02K 33/14; H02K 33/16; H02K 33/18
See application file for complete search history.

(56) References Cited

U.S. PATENT DOCUMENTS

| | | | | |
|---|---|---|---|---|
| 4,750,871 | A * | 6/1988 | Curwen | F04B 35/045 417/320 |
| 5,261,799 | A | 11/1993 | Laskaris | |
| 5,440,183 | A * | 8/1995 | Denne | F15B 15/00 310/12.26 |
| 5,525,044 | A | 6/1996 | Chen | |
| 5,565,752 | A * | 10/1996 | Jansen | H02K 17/165 310/169 |
| 5,772,410 | A | 6/1998 | Chang | |
| 5,809,792 | A | 9/1998 | Song | |
| 5,947,693 | A | 9/1999 | Yang | |
| 6,084,320 | A | 7/2000 | Morita et al. | |
| 6,231,310 | B1 | 5/2001 | Tojo | |
| 6,499,972 | B2 | 12/2002 | Yatsuzuka | |
| 6,644,943 | B1 | 11/2003 | Lilie et al. | |
| 7,378,765 | B2 * | 5/2008 | Iwasa | H02K 33/00 310/14 |
| 7,478,539 | B2 | 1/2009 | Shapiro et al. | |
| 7,663,275 | B2 | 2/2010 | McGill et al. | |
| 8,172,557 | B2 | 5/2012 | Huger et al. | |
| 8,707,717 | B2 | 4/2014 | Fox | |
| 2001/0028200 | A1 * | 10/2001 | Hwang | H02K 9/22 310/12.29 |
| 2002/0101125 | A1 | 8/2002 | Ibuki | |
| 2004/0095028 | A1 | 5/2004 | Shearer et al. | |
| 2006/0201175 | A1 | 9/2006 | Shapiro et al. | |
| 2007/0224058 | A1 * | 9/2007 | Haseley | H02K 41/03 417/415 |
| 2007/0295201 | A1 * | 12/2007 | Dadd | F04B 49/12 92/10 |
| 2009/0081049 | A1 | 3/2009 | Tian et al. | |
| 2010/0183450 | A1 | 7/2010 | Schmidt | |
| 2011/0052430 | A1 * | 3/2011 | Dehnen | F04B 17/044 417/410.1 |
| 2013/0287611 | A1 | 10/2013 | Schmidt | |
| 2015/0125323 | A1 | 5/2015 | Stair et al. | |

FOREIGN PATENT DOCUMENTS

| | | |
|---|---|---|
| EP | 1 582 119 B1 | 10/2005 |
| FR | 1 247 176 A | 11/1960 |
| WO | WO 2017/171816 A1 | 10/2017 |

OTHER PUBLICATIONS

U.S. Patent Office, English language version of the Written Opinion of the International Searching Authority, Form PCT/ISA/237 for International Application PCT/US2018/56103, dated Dec. 21, 2018 (8 pages).

* cited by examiner

FREE PISTON LINEAR MOTOR COMPRESSOR AND ASSOCIATED SYSTEMS OF OPERATION

CROSS REFERENCE TO RELATED APPLICATION

This application is a continuation-in-part of U.S. patent application Ser. No. 14/536,174, filed on 7 Nov. 2014, which claims the benefit of U.S. Provisional Patent Application, Ser. No. 61/901,176, filed on 7 Nov. 2013. The co-pending parent application is hereby incorporated by reference herein in its entirety and is made a part hereof, including but not limited to those portions which specifically appear hereinafter.

GOVERNMENT RIGHTS

This invention was made with government support under Grant No. DE-AR0000257 awarded by the U.S. Department of Energy. The government has certain rights in the invention.

FIELD OF THE INVENTION

This invention generally relates to a linear motor compressor and associated systems and methods for gas compression operation, i.e., a natural gas vehicle home refueling appliance.

DESCRIPTION OF RELATED ART

There is a rapidly developing need for natural gas vehicle (NGV) refueling stations and similar installments that require safe and cost-effective pressurization, movement and delivery of a process fluid, such as natural gas. Such installments may be used to fill vehicles, dispense process fluid, provide pressure boost stations for gas pipelines, fill energy storage systems or storage tanks, refrigeration and process fluid compression and other needs.

Existing natural gas compressors are largely based on reciprocating compressor technology, in which a rotational electric motor drives a crankshaft in a multi-piston compressor. These units suffer from high manufacturing costs, high mechanical parasitic losses, relatively high maintenance costs, and short operational lifespan between repairs. In addition, existing units are often unsuitable for specialty compressor applications where contamination or leakage of the process fluid is unacceptable. Applications requiring high purity process fluids that are compressed to elevated pressures have limited and costly options.

Linear motor compressor controller strategies have generally relied upon mechanical or pneumatic springs or electromagnetic coils to provide stability and ensure the piston has a returning force to center. As an example, U.S. Pat. No. 6,231,310, issued to Tojo et al., stabilizes its system about a central point by using a spring. A position feedback is used to oscillate about the stable position by changing the amplitude and frequency of a sinusoidal source. U.S. Pat. No. 4,750,871, issued to Curwen, stabilizes a linear motor by using external cylinders to hold the reciprocator in a centered position. External AC and DC coils are used to stabilize the system. The disclosed servomechanism is either a series of valves and ports actuated by the motion of the piston or a combination of AC and DC coils activated by position feedback.

A need therefore exists for a simple mechanical solution for a compressor station using a minimum of moving parts in a durable and robust configuration that will also satisfy the specialty compressor requirements.

SUMMARY OF THE INVENTION

Accordingly, the subject invention relates to a Free Piston Linear Motor Compressor (FPLMC), which preferably eliminates all but one major moving part and improves durability and compressor system efficiency, while significantly decreasing manufacturing costs, installation, and maintenance of gas compression, which includes but is not limited to natural gas, other hydrocarbons, hydrogen, and air.

This and other objects of the invention are addressed in one aspect of the invention by a system that includes a multi-stage dual-acting free piston driven by a linear motor. The subject arrangement is preferably used in connection with an integrated staged compressor and linear motor to result in, for example, an appliance for natural gas vehicle fueling, particularly direct fill into an unattended vehicle.

The invention further includes a control strategy that provides stability without the need for a centering force of any kind, whether mechanical or pneumatic springs or electromagnetic coils. The unique ability provided by this invention allows the piston to operate in a stable manner about any point throughout the stroke, not just about center position. With the control strategy of this invention complexity within the linear motor compressor is reduced by removing springs or additional electromagnetic coils, thus simplifying manufacturing and reducing cost and size.

The invention includes a robust free piston linear motor compressor control system that accommodates a wide range of linear motors and power system architectures. In embodiments of this invention, the linear motor compressor includes a compressor housing, a cylinder housing having a plurality of opposing compression chambers, a piston freely reciprocating within the cylinder housing, a linear electric motor positioned to reciprocate the piston, and a piston position feedback control system configured to provide adaptive current output as a function of position feedback and/or velocity feedback from the piston and/or the electric motor, to directly power and control the electric motor.

In embodiments of this invention, the control system determines motor force requirements from estimated position values and/or velocity values. An observer routine can be used to produce the position and velocity estimates from position and current measurement alone.

The control system can include a linear encoder feedback loop to track a position and/or a velocity of the electric motor or the piston. The control system then determines a current required to generate the motor force requirements as a function of the position feedback and/or the velocity feedback. The control system allows the piston to reciprocate without assistance from a mechanical spring or other centering force/mechanism.

In embodiments of this invention, the control system uses reference position values and/or velocity values for comparing to the position feedback and/or the velocity feedback to adjust current to the linear electric motor. The reference signals of the position and/or velocity may be sinusoidal or of random description.

In embodiments of this invention, a linear quadratic regulator is used to provide stable operation while minimizing state error and observing the limits of the control signal.

The controller of this invention is robust enough to handle deviations in behavior between the actual compressor through the entire range of operation and an idealized mass spring system. This has been demonstrated in simulation and hardware with a compressor driven with reluctance linear motor. It has also been demonstrated in simulation with a compressor driven with permanent magnet linear motor. It has further been demonstrated that the control is stable with a bandwidth of 20 kHz which is readily obtainable with a range of digital signal processors.

In embodiments of this invention, the system requires a power system link to be supplied with an unrestricted source to prevent instability between the link and the linear motor.

The control strategy of this invention is capable of being applied to multiple linear motor topologies for the compressor. These include permanent magnet motors, induction motors, voice coil motors, reluctance motors, and/or homopolar induction motors.

BRIEF DESCRIPTION OF THE DRAWINGS

These and other objects and features of this invention will be better understood from the following detailed description taken in conjunction with the following drawings.

DETAILED DESCRIPTION OF THE PRESENTLY PREFERRED EMBODIMENTS

One preferred application of the subject invention relates to refueling of natural gas vehicles. Although described in detail below with respect to NGV refueling stations, the subject invention is not limited to such applications and numerous other suitable applications achieving various pressure levels and producing various flow rates are likewise appropriate for use with the subject invention.

Natural gas refueling in a consumer or home environment is critical to the widespread adoption of natural gas vehicles and presents a unique opportunity for consumers to save significantly on the cost of fuel on a per gallon equivalent advantage over gasoline and diesel and enjoy the convenience of fueling at home. Traditional home refueling appliances (HRAs) have relied on multi-piston reciprocating compressors driven by a rotary electric motor. These systems are complicated, expensive, and have historically suffered poor reliability. The free piston linear motor compressor solves these problems by using a linear motor to drive a single, multi-stage piston, reducing complexity and part count, which improves overall reliability and simplifies manufacturing. Furthermore, efficiency of the linear motor compressor may be improved by operation at a resonant frequency with low friction coatings and reduced clearance volume losses.

To obtain an efficient linear motor design in a compressor application, it should preferably operate at a resonant frequency. This is traditionally accomplished with a mechanical spring in which the mass of the piston and the spring dictate the system's natural, resonant frequency. Heavy duty springs needed for high pressure applications can be bulky and costly, leading to a larger, heavier, and more costly compressor design. Mechanical springs are also often a wear or maintenance item resulting in interruptions in operation of the unit for routine maintenance. Mechanical springs can also be prone to fatigue and catastrophic failure, especially when operated at relatively high frequencies and high temperatures as expected with the natural gas compressor for refueling natural gas vehicles. For at least these reasons, the preferred design preferably does not use mechanical springs, instead utilizing compression chambers as a dual purpose compression chamber and gas spring. This simplifies the design by eliminating all dedicated spring-like components, and simply using the stranded gas remaining in the compression chamber as the spring, allowing for operation at resonance.

Figure 1:
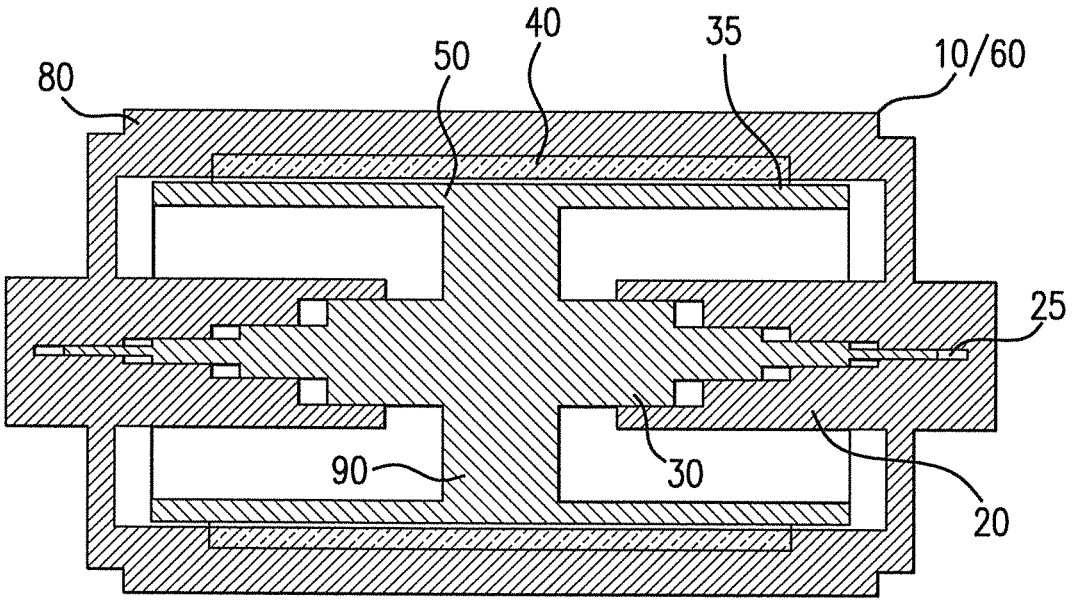
FIG. 1 is a simplified cross-sectional view of a compressor in accordance with one embodiment of the invention.
Figure 2:
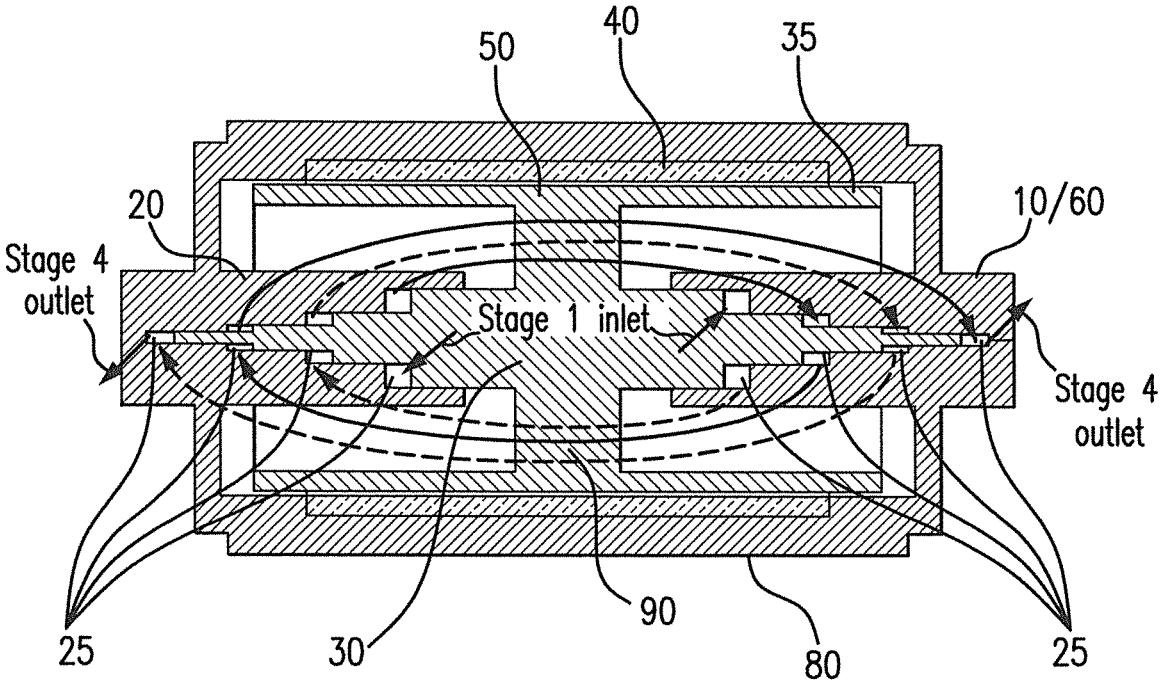
FIG. 2 is a simplified cross-sectional view of the compressor shown in FIG. 1 illustrating dual-acting, four-stage compression circuits.

According to one preferred embodiment, the FPLMC concept, depicted in FIG. 1, includes a symmetric multi-stage dual-acting free piston driven by a linear motor. FIG. 1 shows a four stage unit although other stage increments may be likewise suitable. As shown in FIG. 2, the FPLMC preferably uses compression chambers, in which compression discharge in a lower stage feeds the inlet of the next higher stage. This approach uniquely combines the functions of the compressor and motor into one device with a single moving part, thus eliminating the inefficiencies inherent in converting rotary motion into linear motion. The design results in fewer wearing components, reduced parasitic friction and consequently increased compressor durability, reliability, and reduced maintenance. In addition, the design drastically decreases the overall number of parts, allowing for ease of manufacturing and reduced initial investment. The embodiment shown in FIG. 1, based on analyses discussed below, may comprise an 200 mm (~8 inch) diameter by 400 mm (~16 inch) long device with an estimated mass of 45 kgs (~100 lbs), but may be scaled up or down to achieve a broad range of flow rates and compression ratios.

One preferred compressor design results in four-stages of compression with compression ratios of approximately 4:1 per stage. The design assumes natural gas inlet pressures of 1 bar and has the ability to compress to at least 290 bar. This preferred compressor design operates at 15 Hz resonant frequency and has a natural gas flow rate of 60 liters per minute (~2 standard cubic feet per minute (scfm)). The preferred compressor design is driven by a reciprocating reluctance linear motor operating on 240V, single-phase, 30 A service and capable of providing a 3,000 N compression force.

Thermal management of the linear motor and inter-stage gas are also important as reduced temperatures may further improve the overall compression efficiency of this device. Methods of heat management include forced air or water cooling to integrated heat pipes that use hermetically sealed refrigerants.

A resulting FPLMC making use of a single piston to achieve multiple stages of compression is one preferred component of the subject invention. As a result of the subject invention, a uniquely coupled electromagnetic compressor includes a fully integrated and optimized electric motor and compressor that are no longer independent.

Figure 3:
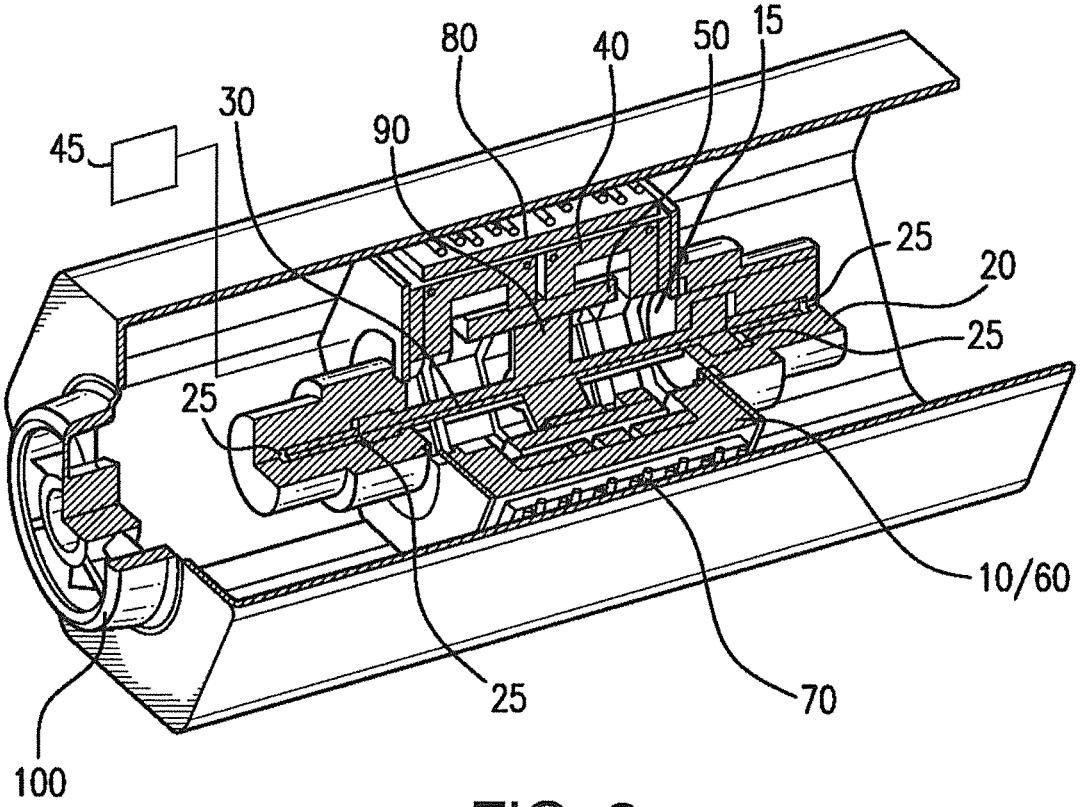
FIG. 3 is a side cross-sectional view of a compressor in accordance with one aspect of the invention.

FIG. 3 shows one preferred embodiment of a free piston compressor that may include one or more of the following components: a compressor housing 10; a multi-stage cylinder housing 20; a compressor piston 30; a motor stator 40; a motor armature 50; a sealed gas flooded housing 60; inter-stage cooling tubes 70; motor cooling fins 80; hub integrating motor and compressor 90; and/or cooling fan 100.

Figure 4:
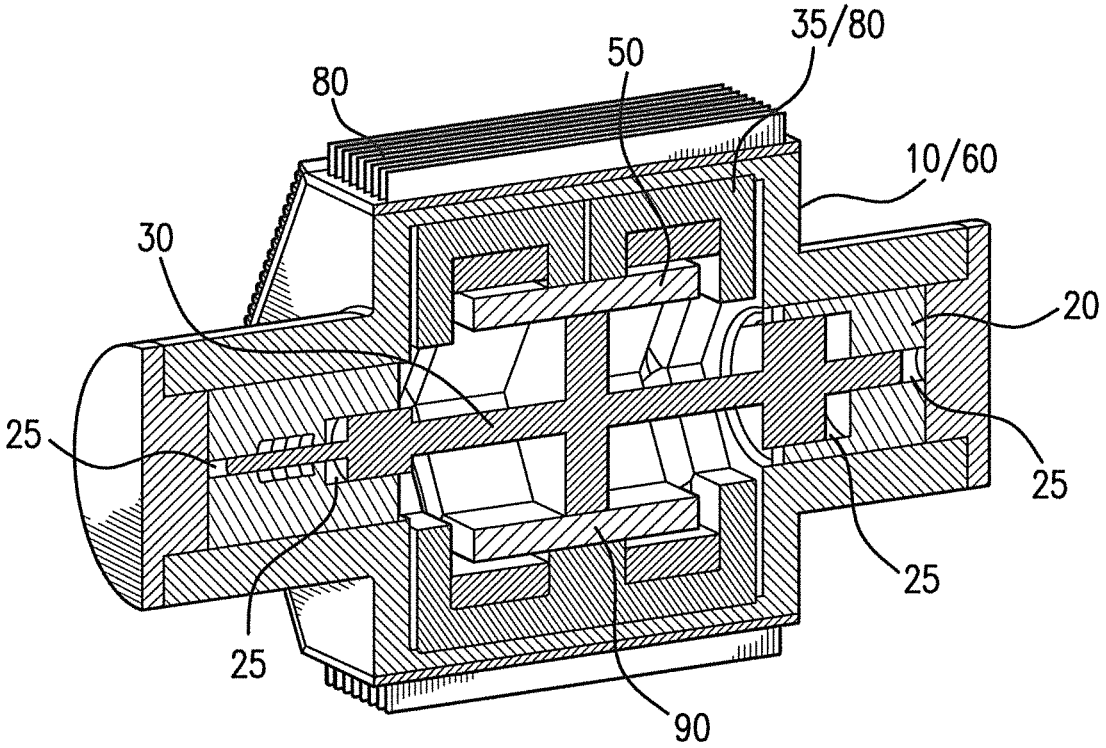
FIG. 4 is a side cross-sectional view of a compressor in accordance with one aspect of the invention.

According to a preferred embodiment of this invention shown in FIG. 4, a linear motor compressor includes a compressor housing 10 having an internal cylinder housing 20 and a plurality of opposing compression chambers 25. The compressor housing 10 and cylinder housing 20 are preferably formed using cast iron alloys, steel alloys, or aluminum alloys using known manufacturing techniques. The opposing compression chambers 25 are preferably arranged opposite each other to facilitate use of a piston arrangement as described in more detail below.

A piston 30 is freely positioned within the cylinder housing 20 to reciprocate freely back and forth or up and down (any orientation is achievable) within the cylinder housing 20 thereby alternatingly charging (pressurizing) opposing compression chambers 25. A preferred arrangement of the piston 30 permits bi-directional drive and free reciprocation within the cylinder housing 20. According to one preferred embodiment, the piston 30 freely reciprocates within the cylinder housing 20 such that compression discharge from an outlet of a chamber of one side of the opposing compression chambers 25 feeds an inlet of another chamber. As described, for maximum efficiency, the piston 30 preferably operates at resonant frequency.

The plurality of opposing compression chambers 25 preferably comprise a series of stepped diameter compression chambers positioned at opposing ends of the cylinder housing 20. Alternatively, the plurality of opposing compression chambers 25 comprise compression chambers of a single diameter at opposing ends of the cylinder housing. The former embodiment may, though not necessarily, be more suited to a plurality of stages while the latter embodiment may be more suited to a single or two stage arrangement.

In this manner, compression is preferably achieved with a single primary moving part. In addition, in a preferred embodiment of this invention, the piston 30 reciprocates without assistance from a mechanical spring. A low friction coating on the piston 30 and/or cylinder housing 20 may be used in combination with a seal material optimized for a process fluid to reduce energy consumption and increase seal life.

In addition, the invention further includes a linear electric motor 35 preferably positioned in-line relative to the compressor housing 10 to reciprocate the piston 30. The linear electric motor 35 may be adapted to the cylinder housing 20 or otherwise positioned in an integrated or non-integrated manner to facilitate efficient reciprocation of the piston 30 within the cylinder housing 20. In one embodiment of this invention, the linear electric motor 35 is directly coupled to the piston 30.

According to one preferred embodiment, the linear motor compressor of the present invention may include a compressor housing 10 and/or a cylinder housing 20 that is pressurized with a process fluid. In addition or alternatively, the compressor housing 10 may include a blowdown volume 15 for depressurizing the compressor and related systems at the conclusion of the compression process. In this manner, the linear motor compressor assembly may be hermetically sealed. By hermetically sealing the compressor chambers 25 and the linear electric motor 35 in the same housing, certain hazards may be avoided when the process fluid is combustible or otherwise volatile. Sealing the relevant components permits operation at high pressures without contamination from outside sources and without risk of combustion due to sparking, arcing or other hazards that may occur depending on the installation.

According to one embodiment, the linear electric motor 35 includes a reluctance motor with dual opposing winding cores. Alternatively, the linear electric motor 35 may comprise a permanent magnet motor, an induction motor, a voice coil motor, a reluctance motor, or an alternative linear motor variant. Further, in one embodiment, the compressor system described herein may include a motor stator fully integrated within the housing. In each case, the preferred linear electric motor 35 will be robust and engineered to endure the high frequency cycles and load volumes expected for applications such as described herein.

The system may additionally be optimized with various further embodiments. For instance, according to one preferred embodiment, an integrated motor and process fluid cooling system may be utilized for heat removal. Integrated motor and interstage gas coolers may use forced air convection and require only one fan or blower.

Also a piston position feedback control system 45 with adaptive current output to minimize energy required to do work may be employed. The preferred embodiment utilizes a linear encoder feedback loop to track the position of the linear motor/piston, allowing the controller to adjust the current up or down in order to maintain an optimized frequency.

In embodiments of this invention, a control strategy provides stability without the need for a centering force of any kind, whether mechanical or pneumatic springs or electromagnetic coils. This ability allows the piston to operate in a stable manner about any point throughout the stroke, and not just about a center position. The control strategy of this invention reduces complexity within the linear motor compressor by removing springs or additional electromagnetic coils, thus simplifying manufacturing and reducing cost and size.

Figure 5:
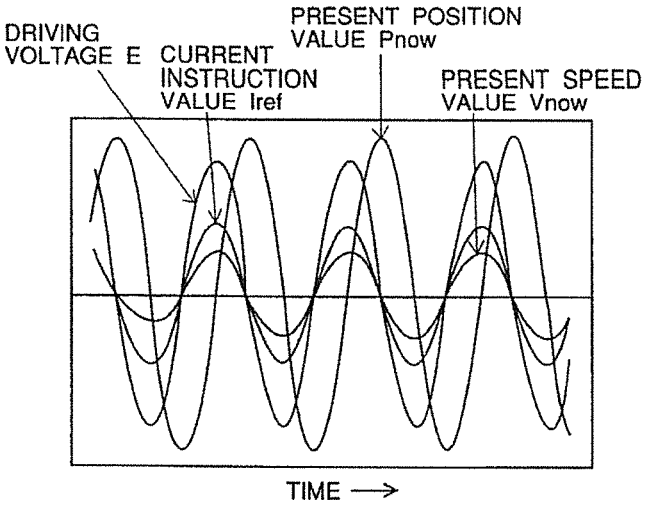
FIG. 5 PRIOR ART
FIGS. 5 and 6 illustrate current produced by a convention system that is largely sinusoidal.
Figure 6:
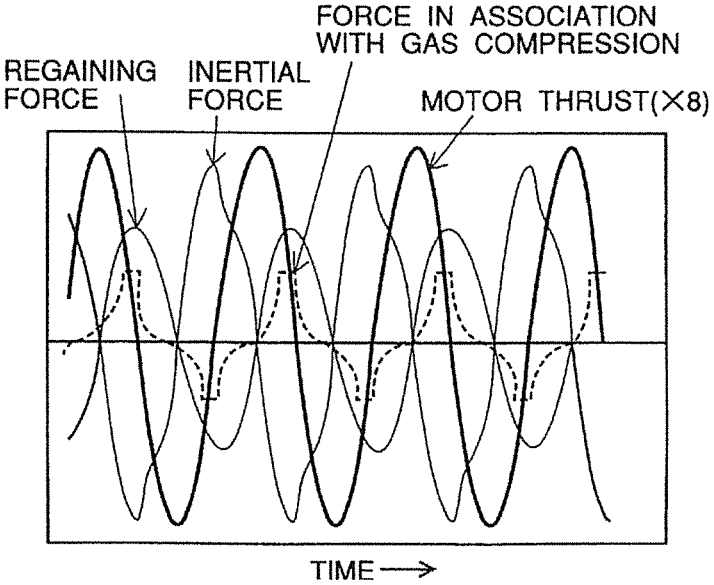
FIG. 6 PRIOR ART

In embodiments of this invention, the control strategy includes position feedback to stabilize a magnetic forcer, at each instant in time using principles of automatic control. This provides improvement over, for example, using position to oscillate by controlling phase and amplitude of a sinusoidal source. FIGS. 5 and 6 representatively show current produced by a convention system that is largely sinusoidal, wherein the phase and amplitude is viable when using spring assist and the motor force is very much sinusoidal and dependent on a stabilizing cylinder or spring regaining force.

Figure 7:
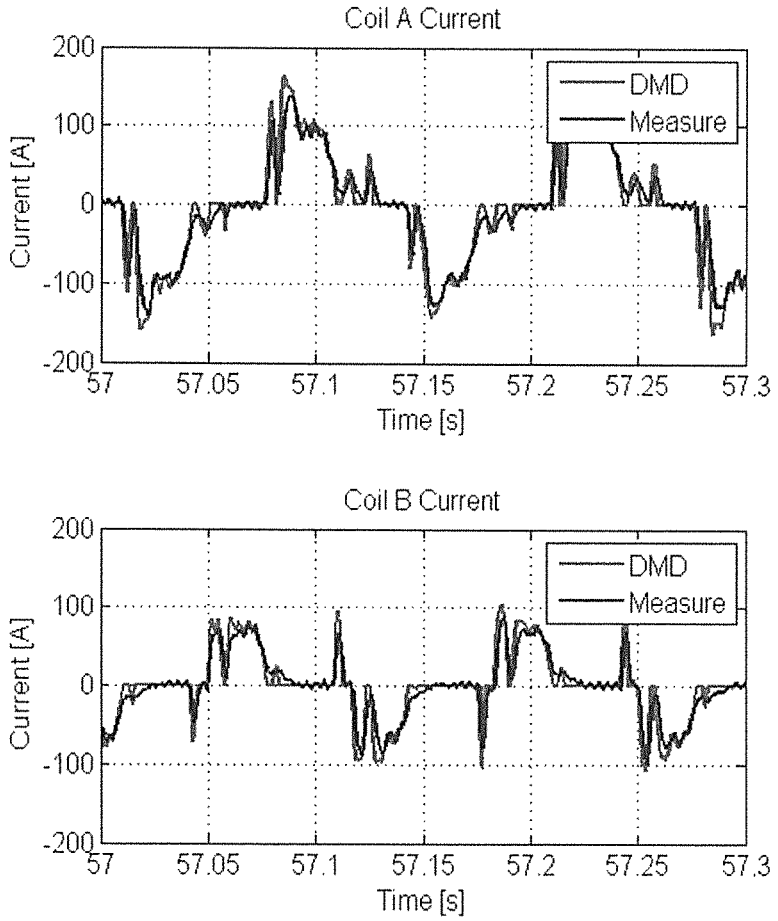
FIG. 7 representatively shows current of two coils A and B, resulting from the control strategy in accordance with one aspect of the invention.

FIG. 7 representatively shows current of two coils A and B, resulting from the control strategy of one embodiment of this invention. The current changes instantaneously with time based on a state space controller, observer, and position and/or velocity feedback. The resulting current profile is not sinusoidal and has the ability to stabilize the system without assistance of springs and/or additional coils.

Figure 8:
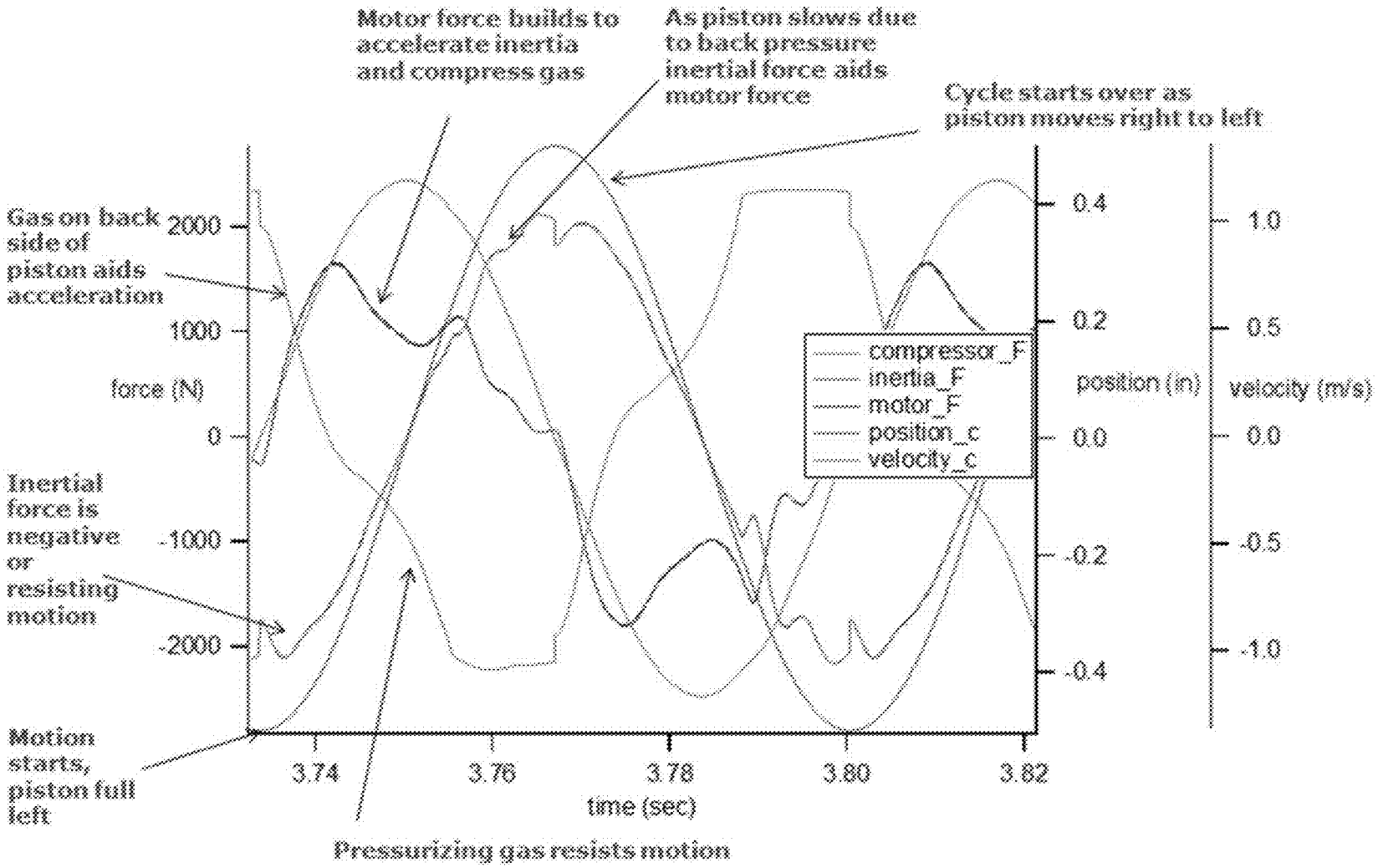
FIG. 8 is a plot illustrating force versus time in accordance with one aspect of the invention.

As illustrated in FIG. 8, in the control approach of embodiments this invention, the motor force is seen to be less than the gas compression force and not sinusoidal. No springs or external stabilizing cylinders are required by stabilizing the motion with the control scheme in the presence of the nonlinear gas compression. In resonant operation, the inertial force and the compressor force are near equal and the motor force is reduced.

Figure 9:
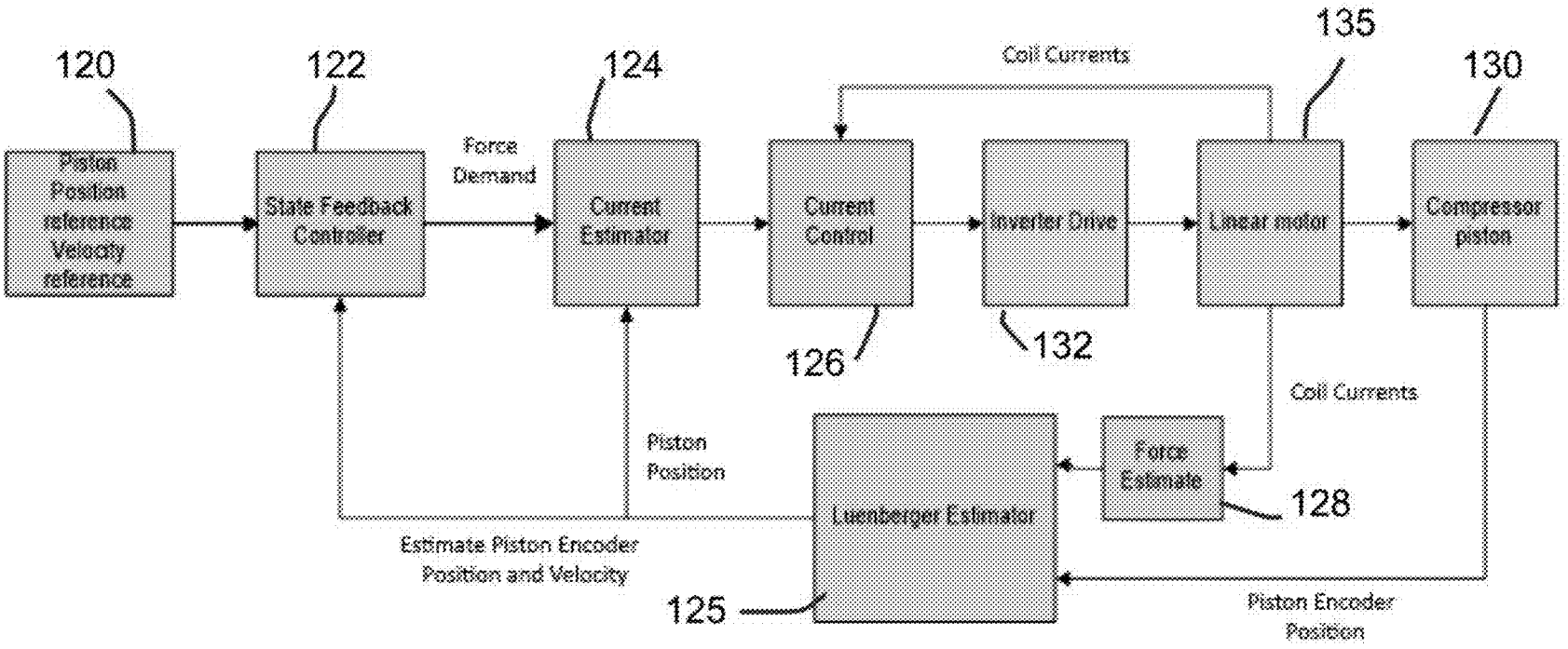
FIG. 9 shows a control architecture for a free piston linear motor compressor in accordance with one aspect of the invention.

FIG. 9 representatively illustrates a flow overview for a control system and the compressor plant according to embodiments of this invention. Boxes 120-128 are elements of the control structure, namely a controller, and boxes 130, 132, and 135 are elements of the corresponding compressor. The controller starts off with the generation of reference curves in box 120 which dictate the position and velocity paths that the flotor (free linear motor rotor equivalent) should follow. These path reference values are sent to state space controller 122 (e.g., a Linear Quadratic Regulator (LQR)) to estimate motor force requirements based on estimated position and velocity values. The next block 124 estimates the coil currents required to generate the force demand based on the estimated flotor position.

These current commands are then fed to a typical PI current control block 126 to control the motor drives 132. The currents delivered to the motor 135 are measured and fed back to the current control 126 and a force estimator 128 based on the actual currents. The linear motor 135 drives the compressor and a linear encoder or potentiometer feeds back position information to an observer, in this case a Luenberger Estimator 125, to estimate position and velocity of the piston 130. The observer is also supplied with the force estimate.

This architecture readily adapts to, without limitation, reluctance, permanent magnet, induction, and/or homopolar motor linear motor variants. For example, in the case of the reluctance motor the current estimator is based on the inductance and inductance gradient as a function of position for the particular motor architecture, whereas for the permanent magnet motor the d-axis and q-axis currents of the three phase motor can be controlled to position the traveling wave, and the resultant d-axis and q-axis voltages are converted to three-phase values through a Parks transformation to gate the inverter. In the case of the reluctance motor the inverter drive is a pair of H-bridges each controlling an individual coil. In the case of the PM motor the inverter drive is a three phase bridge producing the currents to create the traveling wave. It can be seen that the control architecture is robust and readily adaptable to different linear motor types and their control.

Figure 10:
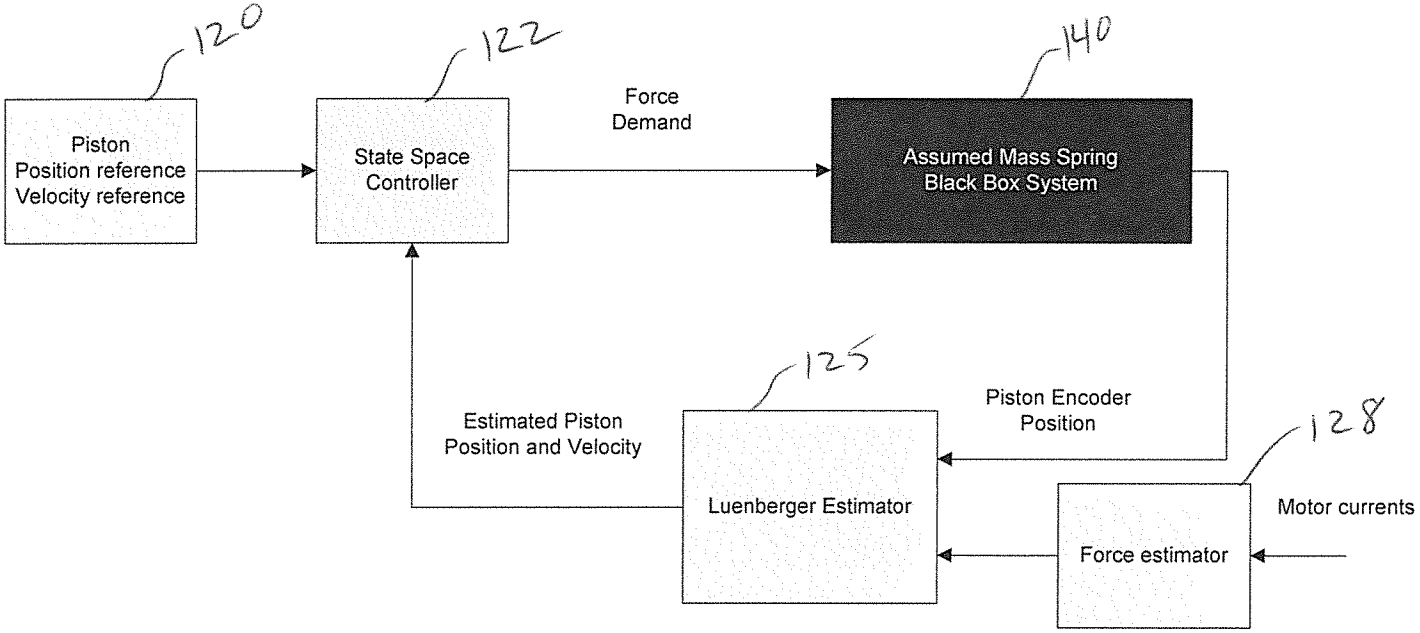
FIG. 10 shows a black box diagram for a controller in accordance with one aspect of the invention.
Figure 11:
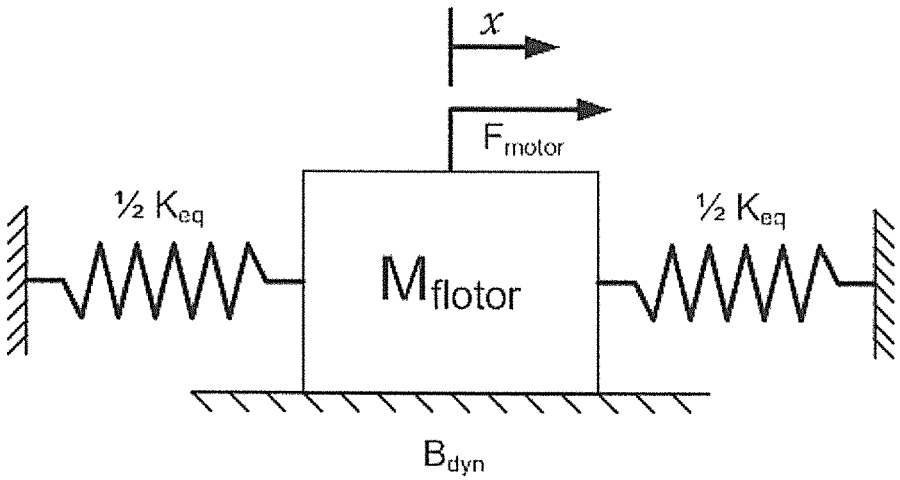
FIG. 11 shows a black box mass spring system in accordance with one aspect of the invention.

In embodiments of this invention, the control can be set up with very little knowledge of what is actually being controlled. The actual compressor plant, motor, and drives can be replaced by a black box 140 as represented in FIG. 10. Modeling of the compressor has shown that the system is quite complicated and would require too much computational power to mirror in an affordable controller. From modeling the compressor, it is recognized that the gas will behave loosely like a spring and offer some level of return force to the piston. Therefore, the primary components of the controller design, e.g., the state space controller 122 and Luenberger estimator 125, assume the plant is a simple, $2^{nd}$ order, linear mass spring system, such as shown in FIG. 11. This gross simplification assumes that the controller will be robust enough to handle the deviations in behavior between the actual compressor through the entire range of operation and the idealized mass spring system.

Figure 12:
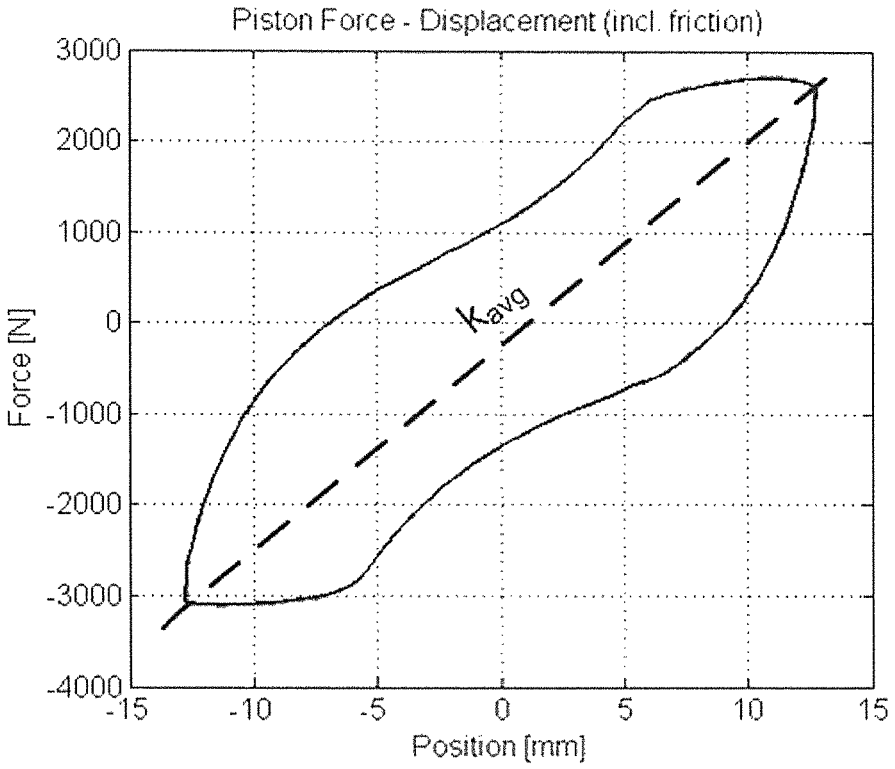
FIG. 12 shows force displacement curves from a compressor simulation in accordance with one aspect of the invention.

By assuming that the black box is a simplified mass-spring system with some potential losses, the gains for the state space controller 122 and Luenberger estimator 125 can be determined using built in routines in Matlab. The mass spring system can be represented in a linear state-space format (1), which is expanded as shown in equation (2), where the states $x_1$ and $x_2$ are the flotor position and velocity, respectively. The important control design parameters in equation (2) are the equivalent spring stiffness, $k_{eq}$, flotor mass, $M_f$, and viscous friction coefficient, $B_d$. The control force is the motor force, $F_m$ The equivalent spring stiffness can be estimated from evaluating the peanut shaped force displacement curves from the compressor simulation, as illustrated in FIG. 12.

$$\dot{x} = Ax + Bu \tag{1}$$

$$y = Cx + Du$$

$$\begin{bmatrix} \dot{x}_1 \\ \dot{x}_2 \end{bmatrix} = \begin{bmatrix} 0 & 1 \\ -\frac{k_{eq}}{M_f} & -\frac{B_d}{M_f} \end{bmatrix} \begin{bmatrix} x_1 \\ x_2 \end{bmatrix} + \begin{bmatrix} 0 \\ 1 \end{bmatrix} F_m \tag{2}$$

$$y = \begin{bmatrix} 1 & 0 \\ 0 & 0 \end{bmatrix} \begin{bmatrix} x_1 \\ x_2 \end{bmatrix}$$

The friction coefficient is typically more difficult to define. The actual friction is coulomb type friction which is not linear and appropriate for the simplified system description. One potential method to estimate a value for $B_d$ is to select a value which will yield an equivalent energy consumption per cycle, E, for the mass spring system as observed from the actual compressor mode, i.e. the area within the force displacement loop (FIG. 12). For a given stroke length, $L_s$, and frequency, f, this estimate can be calculated as follows in equation (3). Of course, changes can be made to this initial estimate, or $B_d$ could be set to zero.

$$B_d = \frac{2E}{L_s^2 \pi^2 f} \tag{3}$$

For a state feedback controller, the required motor force can be calculated by multiplying the state deviations from a reference state by respective gains, $K_1$ and $K_2$. The behavior of a full state feedback controller will result in the system equation (4). To ensure stability in equation (4), the gains must be selected so that (A−BK) has all negative eigenvalues.

$$F_m = -Kx = [K_1 \quad K_2] \begin{bmatrix} x_{1_ref} - x_1 \\ x_{2_ref} - x_2 \end{bmatrix} \tag{4}$$

$$\dot{x} = (A - BK)x \tag{5}$$

The gain values K can be selected by pole placement schemes to achieve a desired response. The issue here is that there is literally an infinite number of pole options to choose from. To simplify the task, the state feedback controller has been limited to a specific type of controller, referred to as a Linear Quadratic Regulator (LQR). LQR control is a type of optimal controller that is really a sub-optimal control. This sub-optimal control seeks to minimize the infinite horizon cost function:

$$J(t_0)=\tfrac{1}{2}\int_0^{\infty}(x^tQx+u^tRu)dt \tag{6}$$

where Q is a weighting matrix that penalizes deviations in the state variable and R is a weighting matrix that penalizes the amount of input used to control the system. The matrix Q must be semi-positive definite, and R must be positive definite. To get the gain values K from this cost function requires solving the Algebraic Ricatti Equation (ARE). Matlab offers a function, lqr, which will calculate the gains, ARE solution, and resulting pole locations (4), for a system defined by A and B, with weighting matrices Q and R.

Next the weighting matrices Q and R can be determined. To determine these values, the method referred to as "Byron's Rule" can be followed. First off, R is set to a value of 1. This makes R positive definite, as required. (Also, as one goes through to solve the ARE, one will notice that Q and R become a ratio, so R might as well be set to unity). For Q, Byron's rule suggests using a diagonal matrix as follows:

$$Q=\begin{bmatrix} q_{11} & 0 \\ 0 & q_{22} \end{bmatrix}=\begin{bmatrix} \frac{1}{\delta x_1^2} & 0 \\ 0 & \frac{1}{\delta x_2^2} \end{bmatrix} \tag{7}$$

where $\delta x_1$ and $\delta x_2$ are the largest acceptable state deviations. In addition with the model parameters defined by A, these are the additional parameters for tuning the LQR controller.

A preferred method of tuning is by changing the values $\delta x_1$ and $\delta x_2$ which are from the previous discussion. Decreasing these values will increase the gains, i.e., less acceptable path error. It was found that gain tuning was more sensitive to $\delta x_1$ than $\delta x_2$. The variable $\delta x_1$ can be set relatively tight to values of 1e-7 to 1e-5, while $\delta x_2$ can be kept to 1 or greater. If either of these variables are set too small, very large control gains will be calculated which can drive the actual system unstable. Very large gains here will also increase the observer gains and cause computational slow down, plus possible unstable behavior.

Figure 13:
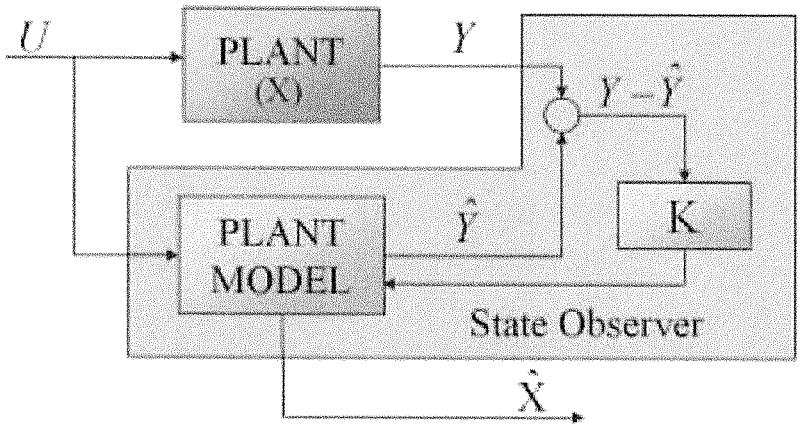
FIG. 13 is a state observer in accordance with one aspect of the invention.

The motor design of embodiments of this invention only measures the flotor position, which is provided by a digital encoder. For the LQR state feedback controller to work, both position and velocity must be provided. To estimate the flotor position and velocity, a Luenberger observer is employed, such as shown in FIG. 13. This state observer estimates the flotor position and velocity based on the dynamics of the linear mass-spring plant model along with force inputs and measured encoder position.

State estimates can be calculated by solving the following differential equation:

$$\dot{\hat{x}}=A\hat{x}+Bu+L(y_m-C\hat{x}) \tag{8}$$

where C is the linear system output matrix, and $y_m$ is the measured signal, which is the encoder measurement in our case. The control input u is the motor force, $F_m$. For the observer, this value is not the requested motor force derived from the state space controller, but rather the calculated force based on coil current measurements and coil inductances estimated from estimated position The observer gains are defined by the vector L. These gains are selected so that (A–LC) produces a pair of stable negative eigenvalues. As mentioned for state space controller, pole placement techniques can be used to determine the locations of these eigenvalues. For the observer to function properly with the state feedback controller, the observer should respond at least 10 times faster than the closed loop state feedback controller. Since the pole locations for the LQR controller have been determined, the L vector is calculated by placing the eigenvalues of (A–LC) to 10 times the LQR values. This solution can be accomplished using the "place" command in Matlab.

Location of the physical control hardware can be important in various embodiments of the invention. The DSP, the power electronic gate fiber optic transmitters, the position encoder power supply, and the power supplies for the current measurement transducers are desirably in one Faraday enclosure. The DSP and fiber optic transmitters desirably derive their power from a common supply. The gate leads from the fiber optic receiver cards to the transistors desirably are twisted pair shielded. The power supplies for the transistor gate circuits and any relay controls (i.e., soft start and dump link capacitor) typically should be plugged into isolation transformers. Any signals entering or leaving the Faraday enclosure desirably are passed through wave guides. Galvanic signals coming into the Faraday enclosure should be kept at a minimum. If possible, the DSP desirably has differential inputs for analog input signals.

A mechanical failsafe (not shown) may be further incorporated into the subject invention, for instance using compliant stator laminations and compressor heads to decelerate the piston during a failure mode. Ideally, in the event of an impact and control system failure, armature motion will automatically be contained in a fail-safe manner, greatly reducing the potential for damage or gas leaks.

According to a preferred embodiment of this invention, the arrangement of components as described may result in the following preferred or unique features/attributes of the invention. It is desirable for the invention to include one or more stages of compression with a single piston. Motive force is preferably supplied with a custom designed linear reluctance motor, although other motor variants such as permanent magnet, induction, and homopolar induction have also been designed.

According to one embodiment of the linear electric motor 35, a reluctance motor may include dual opposing winding cores that provide reciprocating linear motion. A reluctance motor armature, or moving part, has low losses and allows for a sealed motor housing, which can act as a receiver volume for the depressurization of the compressor.

In the preferred embodiment, compression stages are designed such that the differential pressure acting across seals is reduced by placing lower stages next to higher stages such that the pressure of the lower stage is acting on the back of the high pressure stage. This reduces the net force acting on the seal, improving seal life and durability.

Low profile valve design and unique valve locations preferably minimize a volume in the compressor which does not contribute to work. This improves the efficiency and reduces net power required for compression. The compressor cylinders may be manufactured with unique interlocking scheme to allow ease of alignment and service.

The linear motor compressor of the subject invention may further include a directly coupled compressor piston and motor armature. For example, a rigid piston or a flexible coupling may be positioned between the piston and an armature of the linear electric motor. The flexible coupling between compressor piston and motor armature as described preferably allows for independent alignment.

Resonant frequency operation preferably based on mass and dynamic gas spring may be used to increase system efficiency. As described, a dynamic gas spring preferably replaces a mechanical spring in the subject system. Advanced controls allow for operation without mechanical springs.

Advanced controls may further allow for minimal gap/volume at end of compression stroke, thus minimizing volume which does not provide useful work. In addition, such controls may enable position only control, velocity only control, or control with no external sensors (sensorless control) through active inductance measurements of the linear motor coils.

The reluctance motor as described may use laminated polygonal design to reduce cost and ease fabrication and assembly. The segments are preferably laminated in the direction perpendicular to current flow to limit losses and improve controllability. One coil preferably links all polygonal segments eliminating end turns in the individual segments and reducing losses. In addition, the segments preferably lock into a sealed stator housing. As described above, the motor is preferably vacuum pressure impregnated to provide insulation integrity. Alternatively, the reluctance motor may use a circular lamination design with similar design and benefits as described above.

As described, the resulting FPLMC system creates numerous advantages including: (1) reduces friction losses, no rotary to linear motion conversion; (2) reduces part count, uses single piston for multiple stage compression; (3) reduces differential seal pressure, increases seal life; (4) reduces moving parts, reduces maintenance; (5) control algorithm allows removal of mechanical spring typically used in linear motor compressor for resonant frequency operation; (6) reluctance motor design allows for sensorless control, eliminating additional sensors which add to cost and prone to fail; and/or (7) reduces costs and increases overall reliability of gas compressor.

Other potential markets, besides direct natural gas vehicle refueling include: (1) commercial CNG fleets where a low cost compressor could be paired with multiple vehicles for the convenience of unattended fueling; (2) assisting with NGV fast-fill dispensing to complement storage pressure equalization; (3) gas pipeline pressure boost stations; (4) hydrogen vehicles refueling; (5) air compressors for SCBA, SCUBA, and energy storage systems; (6) refrigeration and industrial gas compression; and/or (7) on-board a vehicle fuel pressure booster compression to deliver fuel to the engine of the vehicle.

While in the foregoing specification this invention has been described in relation to certain preferred embodiments thereof, and many details have been set forth for purpose of illustration, it will be apparent to those skilled in the art that the invention is susceptible to additional embodiments and that certain details described herein can be varied considerably without departing from the basic principles of the invention.

We claim:

1. A linear motor compressor comprising:

a cylinder housing having opposing compression chambers;

a piston freely reciprocating within the cylinder housing, a linear electric motor positioned to reciprocate the piston, the linear electric motor comprising a three-phase permanent magnet motor; and a piston position feedback control system configured to provide adaptive current output as a function of position feedback and velocity feedback from the piston and/or the electric motor, to form and control a traveling electromagnetic wave within the electric motor that moves the piston, wherein d-axis and q-axis currents of the three-phase permanent magnet motor are controlled to position the traveling electromagnetic wave.

2. The linear motor compressor of claim 1 wherein the control system determines motor force requirements from estimated position values and velocity values.

3. The linear motor compressor of claim 1 wherein the control system determines a current required to generate the motor force requirements as a function of the position feedback and the velocity feedback.

4. The linear motor compressor of claim 1 wherein the control system comprises a digital linear encoder configured to continually measure a position of the piston along a length of a reciprocation path, and an observer to estimate a piston position and velocity from the measured position of the digital linear encoder.

5. The linear motor compressor of claim 1 wherein the control system comprises reference position values and velocity values for comparing to the position feedback and the velocity feedback to adjust current to the linear electric motor.

6. The linear motor compressor of claim 1 wherein the piston reciprocates without assistance from a mechanical spring or a centering force.

7. The linear motor compressor of claim 1 wherein the linear electric motor comprises a motor armature directly coupled to the piston.

8. The linear motor compressor of claim 1 wherein the piston operates at resonant frequency.

9. The linear motor compressor of claim 1 wherein the opposing compression chambers comprise a series of stepped diameter compression chambers positioned at opposing ends of the cylinder housing.

10. The linear motor compressor of claim 1, wherein the cylinder housing includes the piston freely reciprocating within the cylinder housing, wherein compression discharge from an outlet of a chamber of one side of the opposing compression chambers feeds an inlet of another chamber and a first stage of compression is drawn from the blowdown volume.

11. The linear motor compressor of claim 1 wherein the piston position feedback control system comprises a digital encoder along a length of a piston reciprocation path to continually measure a position of the piston along the piston reciprocation path, and an observer to estimate a current from measured positions from the digital encoder.

12. The linear motor compressor of claim 1 further comprising an inverter drive connecting the piston position feedback control system to the linear electric motor, the inverter drive comprising a three phase bridge connected to the linear electric motor and configured to produce the adaptive current output to create and move the traveling wave, wherein d-axis and q-axis voltages are converted to three-phase values through a Parks transformation to gate the inverter drive.

* * * * *